US007128598B2

(12) United States Patent
Ebert et al.

(10) Patent No.: US 7,128,598 B2
(45) Date of Patent: Oct. 31, 2006

(54) CABLE HOLDER

(75) Inventors: Wolfgang Ebert, Trostberg (DE); Wolfgang Mayer, Chieming (DE)

(73) Assignee: Patent-Treuhand-Gesellschaft fur Elektrisch Gluhlampen mbH (DE)

( * ) Notice: Subject to any disclaimer, the term of this patent is extended or adjusted under 35 U.S.C. 154(b) by 0 days.

(21) Appl. No.: 11/287,437

(22) Filed: Nov. 28, 2005

(65) Prior Publication Data

US 2006/0121774 A1 Jun. 8, 2006

(30) Foreign Application Priority Data

Dec. 2, 2004 (DE) ..... 10 2004 058 195

(51) Int. Cl.
*H01R 12/24* (2006.01)

(52) U.S. Cl. ..... 439/495; 439/445

(58) Field of Classification Search ..... 439/495, 439/445, 493, 492, 752, 468
See application file for complete search history.

(56) References Cited

U.S. PATENT DOCUMENTS 4,217,465 A * 8/1980 Holden ..... 174/138 F
4,325,599 A * 4/1982 Feldman ..... 439/468
4,797,112 A * 1/1989 Weisenburger ..... 439/55
6,520,797 B1 * 2/2003 Okamura et al. ..... 439/495
6,645,001 B1 * 11/2003 Okano ..... 439/492
2003/0108301 A1 * 6/2003 Bates et al. ..... 385/59
2004/0235364 A1 * 11/2004 Matsumoto et al. ..... 439/752
2006/0116021 A1 * 6/2006 Dennes et al. ..... 439/445

* cited by examiner

*Primary Examiner*—Michael C. Zarroli
(74) *Attorney, Agent, or Firm*—Fitch, Even, Tabin & Flannery

(57) ABSTRACT

A cable holder 1 for a large number of connection cables 2, 4, 6, 8 of an electrical or electronic control device, in particular of an electronic ballast of a lamp. The cable holder 1 has a base body 24, in which receptacles 32, 34, 36, 50 are formed which surround, at least in sections, an insulating sheath of the connection cables 2, 4, 6, 8 and are associated with apertures 38, 40, 42, 52, which open out into an end face 44 of the base body 24, cable ends 12, 14, 16, 18, from which the insulation has been stripped, of the connection cables 2, 4, 6, 8 extending through the apertures 38, 40, 42, 52.

14 Claims, 2 Drawing Sheets

CABLE HOLDER

TECHNICAL FIELD

The invention relates to a cable holder for connection cables of a control device and to an electronic ballast designed to have at least one such cable holder.

BACKGROUND ART

Owing to a negative current/voltage characteristic, some lamps, for example, fluorescent lamps, require current limitation devices. Previously, conventional alternating coils which are connected in series with the lamp in conjunction with a starter were used for this purpose. Owing to the high losses in the inductor, these conventional ballasts have been replaced in recent years by electronic ballasts, by means of which the required system performance (the lamp including the ballast) is considerably reduced with respect to the conventional solutions given approximately the same luminous flux of the lamp. For the NAFTA (North American Free Trade Agreement) market, these electronic ballasts (EBs) are predominantly supplied with connection cables which are soldered fixedly to a printed circuit board of the EB as early as during production. One disadvantage of this is the fact that these connection cables, which have been fixedly soldered in, make manufacture of the electronics, with the fitting, soldering and testing of the electronic components arranged on the printed circuit board, more difficult, since these connection cables take up a considerable amount of physical space and are difficult to manipulate owing to their number and rigidity. With sequential fitting of the individual connection cables there is also the risk of positions or colors being mixed up, i.e. erroneous fitting of cables such that there are increased requirements for quality control checks.

The cables also need to be passed through cutouts in a housing wall of the EB and in the process electrically insulated and mechanically protected. Another disadvantage of the conventional solutions consists in the fact that this mounting step is comparatively complex since, for this purpose, the individual connection cables need to be inserted into plastic bushings and then the plastic bushings need to be threaded into the cutouts in the EB housing wall in a subsequent manufacturing step.

DISCLOSURE OF THE INVENTION

The invention is based on the object of simplifying mounting of connection cables for electrical and electronic control devices.

This object is achieved by a cable holder having a base body, in which receptacles are formed which surround, at least in sections, an insulating sheath of the connection cables and are associated with apertures, which open out into an end face of the base body, cable ends, from which the insulation has been stripped, of the connection cables extending through said apertures such that they protrude out of the end face and by an electronic ballast provided with at least one such cable holder. Particularly advantageous embodiments of the invention are described in the dependent claims.

The cable holder according to the invention for a large number of connection cables of an electrical or electronic control device, in particular of an electronic ballast for lamps, has a base body, in which receptacles are formed for an insulating sheath of the connection cables. The receptacles are associated with apertures which open out into an end face of the base body, cable ends, from which the insulation has been stripped, of the connection cables extending through said apertures such that they protrude out of the end face of the base body. According to the invention, the connection cables are thus fixed in a predetermined relative position in relation to one another via the cable holder and are delivered as a preassembled unit. Once the printed circuit board has been fitted with the electronic components, for example of an electronic ballast, this preassembled unit (cable holder with connection cables) can then be processed in a simple manner by the protruding cable ends, from which the insulation has been stripped, being selectively soldered to the printed circuit board. The geometry of the cable holder is designed such that the individual cable ends are arranged in the predetermined relative position in relation to one another such that fitting, soldering and testing of the printed circuit board can be carried out in a substantially more simple manner than in the prior art described initially. Since the cable holder according to the invention can be prefabricated by mass production and with little complexity, erroneous fitting is virtually ruled out.

In one particularly preferred exemplary embodiment, the cable holder is designed such that the connection cables are arranged so as to lie next to one another essentially in one plane.

Bearing projections are provided at the end face, out of which the cable ends protrude.

It is particularly preferred if the connection cables are deflected in the cable holder through approximately 90° such that the cable ends, from which the insulation has been stripped, extend such that they are offset through approximately 90° with respect to the axis of the connection cables. In this manner, the cables are secured against being pulled out.

The receptacles of the cable holder are preferably in the form of pockets which surround, in an interlocking manner, a circumferential section of an insulating sheath of the connection cables. In order to simplify assembly and production, these pockets have lateral slots.

In the case in which a 90° deflection takes place in the cable holder, these pockets are preferably formed in the region of the deflected cable ends.

In one exemplary embodiment, the connection cables enter the cable holder through an insertion opening. This insertion opening is preferably designed to have an approximately U-shaped cross section in a further end face of the cable holder, this end face then correspondingly being arranged such that it is offset through 90° with respect to that end face, out of which the cable ends, from which the insulation has been stripped, protrude.

The mounting complexity can be further reduced if the cable holder is provided with an integrated housing bushing, which is preferably formed in the region of this abovementioned insertion opening. Assembly during prefabrication can be further simplified if this housing bushing is connected to a closure part via a film hinge, said closure part forming, in its closed position, a circumferential section of the insertion opening such that the connection cables are surrounded by the housing bushing.

Said housing bushing preferably has one or more grooves on its outer circumference, circumferential edges of the housing wall entering said grooves.

The production of the cable holder is particularly simple if the pockets for the purpose of accommodating the cable ends are formed in an accommodating region which protrudes from a base plate, the insulating sheaths of the connection cables bearing against this base plate.

Such a cable holder is preferably produced from plastic in an injection molding method.

BRIEF DESCRIPTION OF THE DRAWINGS

The invention will be explained in more detail below with reference to a preferred exemplary embodiment. In the drawing.

BEST MODE FOR CARRYING OUT THE INVENTION

Figure 1:
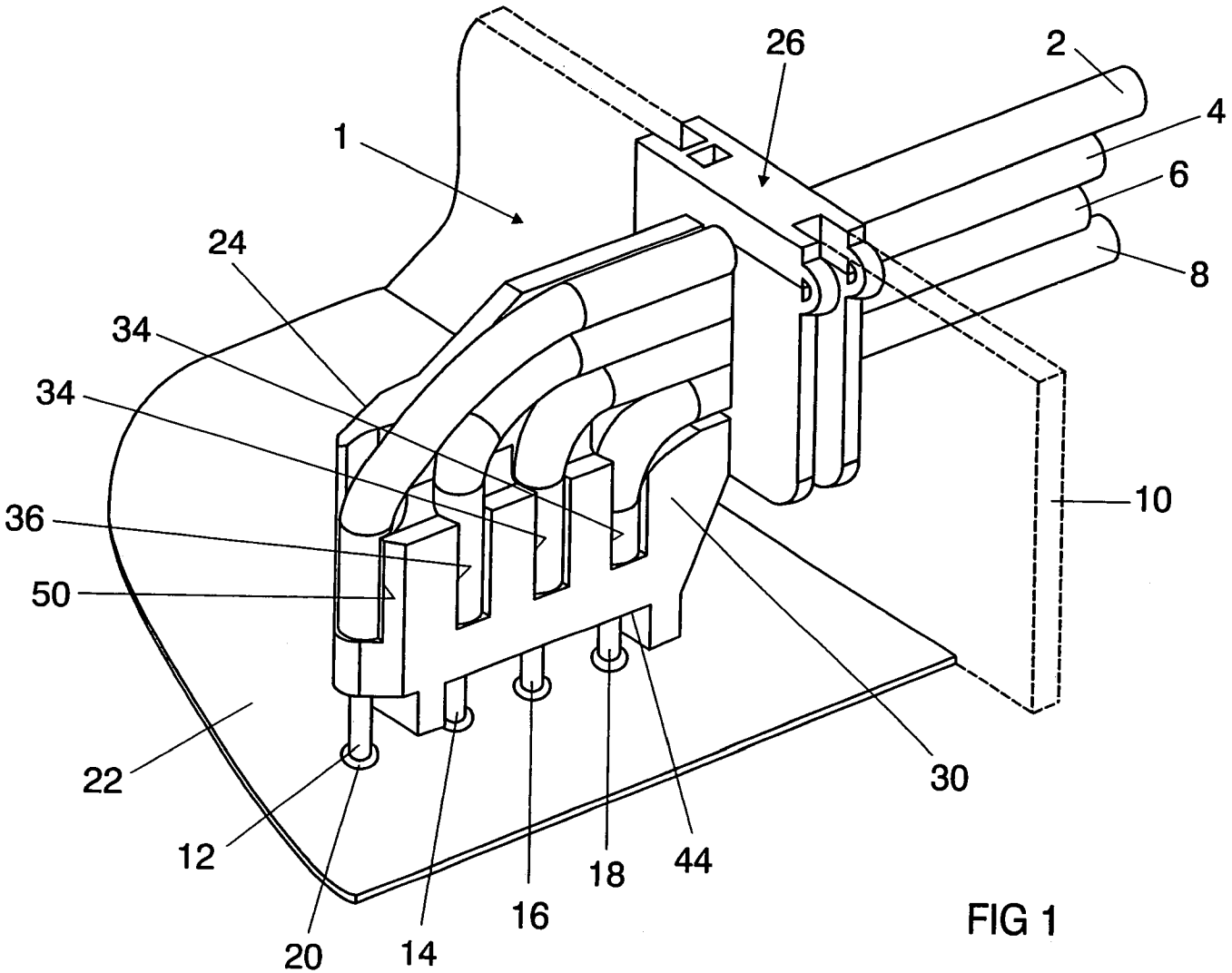
FIG. 1 shows a cable holder for four connection cables of an electronic ballast.

FIG. 1 shows a three-dimensional illustration of a cable holder 1 for the purpose of fixing four connection cables 2, 4, 6, 8 in position, said connection cables extending through a cutout in a housing wall 10 (indicated by dashed lines) of a housing of an electronic ballast (EB). Cable ends 12, 14, 16, 18, from which the insulation has been stripped, of the connection cables 2, 4, 6, 8 protrude out of the cable holder 1 and are each connected to conductor tracks on a printed circuit board 22 by means of a soldered connection 20. The geometry of the cable holder 1 is designed such that the cable ends 12, 14, 16, 18 are positioned in a predetermined relative position in relation to one another which corresponds to the relative position of the soldered connections 20 in relation to one another, with the result that the cable ends 12, 14, 16, 18 are already aligned in relation to the predetermined soldered points once the cable holder 1 has been inserted into the housing wall 10.

Figure 2:
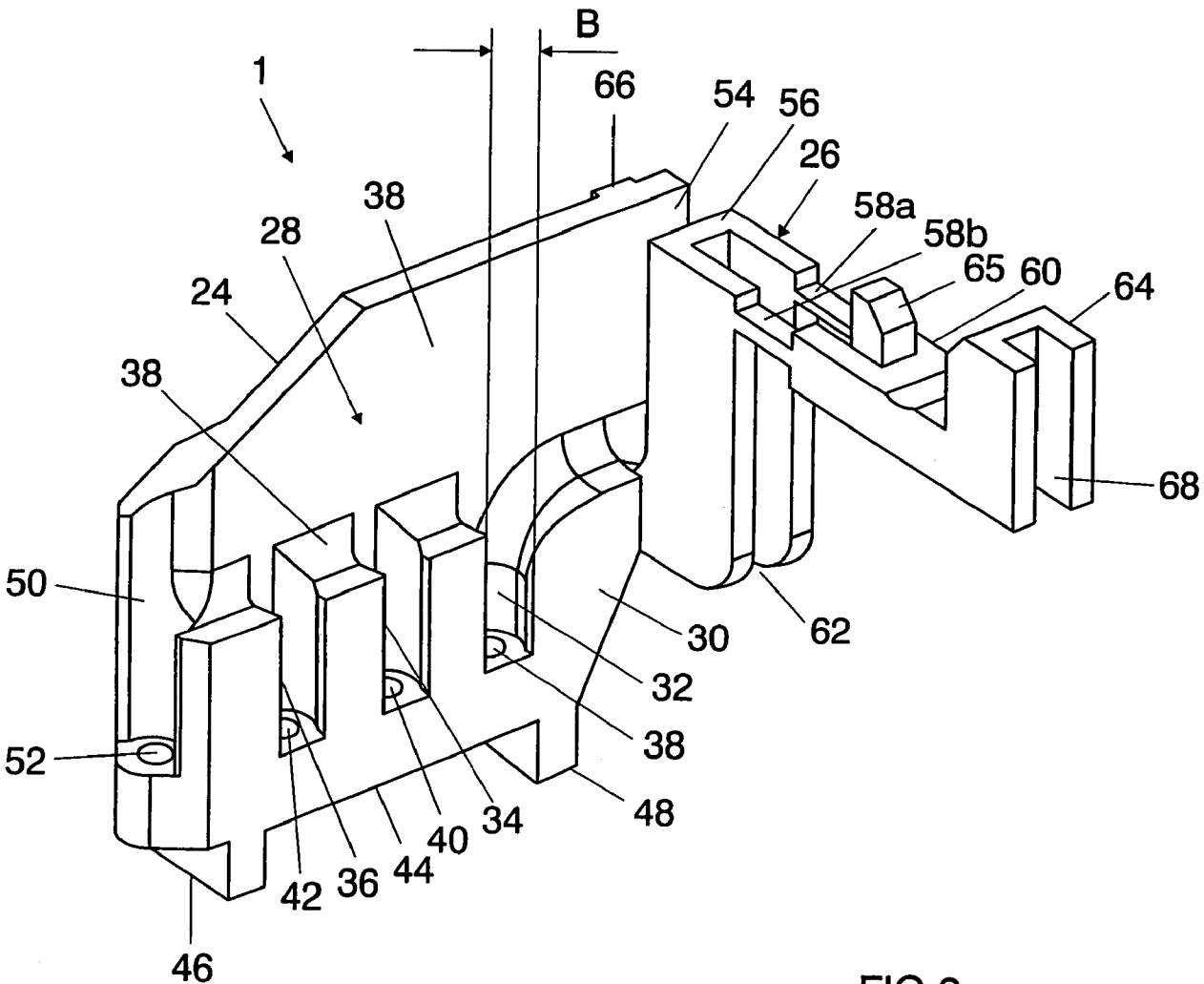
FIG. 2 shows the cable holder shown in FIG. 1 before insertion of the connection cables.

FIG. 2 shows the cable holder 1 shown in FIG. 1 without the connection cables 2, 4, 6, 8 inserted. This cable holder 1 is produced from plastic in an injection molding method and has a base body 24, in which a housing bushing 26 is integrated. The base body 24 has a base plate 28, which is extended downwards (view in FIG. 2) in the form of a step to form an accommodating region 30. In the exemplary embodiment illustrated, three pockets 32, 34, 36 are formed in this extended accommodating region 30, said pockets 32, 34, 36 extending downwards (FIG. 2) from a step face, designed with a flute, of the accommodating region 30. The clear width of the pockets 32, 34, 36 is matched to the outer diameter of the insulating sheaths of the connection cables 2, 4, 6, 8. In the exemplary embodiment illustrated, the pockets 32, 34, 36 have cylindrically curved circumferential sections, whose diameter essentially corresponds to that of the connection cables 2, 4, 6, 8. In order to simplify assembly and the injection molding die, the pockets 32, 34, 36 are open at the side towards the base face (visible in FIG. 2) of the accommodating region 30. The width B of the slots produced in the process is, however, less than the outer diameter of the connection cables 2, 4, 6, with the result that said connection cables 2, 4, 6 are accommodated in an interlocking manner in the pockets 32, 34, 36.

Apertures 38, 40, 42, whose clear width is selected to be slightly larger than the diameter of the cable ends 12, 14, 16, 18, which have been freed of the insulating sheath, in each case open out into base faces of the pockets 32, 34, 36. These apertures 38, 40, 42 open out into an end face 44, which lies at the bottom in FIGS. 1 and 2 and out of which two bearing projections 46, 48 protrude, with which the cable holder 1 rests on the base face of the printed circuit board 22. The annular end faces of the insulating sheaths in this case rest on the base faces of the pockets 32, 34, 36.

In the exemplary embodiment illustrated, a further pocket 50 is formed on the end side formed by the base plate 28 and the accommodating region 30, said further pocket 50 having essentially the same design as the above-described pockets 32, 34, 36. An aperture 52 opens out into the base face of this further pocket 50, and the cable end 12, from which the insulation has been stripped, of the connection cable 2 extends through said aperture 52, as shown in FIG. 1.

As shown in FIG. 1, the four connection cables 2, 4, 6, 8 are deflected, within the cable holder 1, through 90° with respect to the base face of the printed circuit board 22. The connection cables 2, 4, 6, 8 are fed through an insertion opening 54 in the cable holder 1, which insertion opening 54 is delimited by the housing bushing 26. This housing bushing 26 has a holder 56, which runs transversely with respect to the base plate 28 and is connected to a closure part 60 via a two-limbed film hinge 58*a*, 58*b*. A circumferential groove 62 is formed in the end faces, which run vertically in the illustration shown in FIG. 2, and in the lower end face of the holder 56, the circumferential edges of the cutout formed in the housing wall 10 entering said groove 62, as shown in FIG. 1. A centering projection 65 is formed on the closure part 60, enters the groove 62 when the closure part 60 is closed (pivoting through 180°) and thus centers the closure part 60 with respect to the holder 56. This closure part 60 then covers the insertion opening.

At the end section, which is remote from the film hinge 58*a*, 58*b*, of the closure part 60, a latching projection 64 is formed which forms a latching connection with latching elements 66 of the holder 56 in order to hold the closure part 60 in its latching position (FIG. 1). In this position, the insertion opening 54 for the connection cables 2, 4, 6, 8 is closed on the circumference side such that the four connection cables 2, 4, 6, 8 are fixed in position such that they lie next to one another in one plane and bear against the base face (shown in FIGS. 1 and 2) of the base plate 28 and are then deflected downwards, towards the pockets 32, 34, 36 and 50.

As shown in FIG. 2, a groove section 68 is formed on the end face of the latching projection 64, said groove section 68 being supplemented by the groove 62 in the latching position and surrounding the cutout in the housing wall 10.

In the solution according to the invention, the connection cables 2, 4, 6, 8 are fitted in advance and held together by means of one or more of the cable holders 1 according to the invention. For this purpose, the cable ends 12, 14, 16, 18 have the insulation stripped from them once the connection cables 2, 4, 6, 8 have been cut to length and are inserted into the correspondingly indicated and provided pockets 32, 34, 36, 50 when the closure part 60 is open such that the cable ends 12 protrude out of the end face 44. Then, those regions of the connection cables 2, 4, 6, 8 which adjoin the cable ends 12, 14, 16, 18 are deflected through approximately 90° in the manner illustrated in FIG. 1 and are inserted into the accommodating opening 54 such that all of the connection cables 2, 4, 6, 8 come to lie essentially in one plane. In a next step, the closure part 60 is pivoted through 180° and latched such that the connection cables 2, 4, 6, 8 are fixed in position in a reliable manner. This unit which has been prefabricated by mass production is then retrofitted once the fitting, soldering and testing of the printed circuit board is complete and is selectively soldered, the cable holder 1 resting, in the mounting position, with its bearing projections 46, 48 on the base face of the printed circuit board 22 and, after soldering, the housing bushing 26 being inserted into the cutout in the housing wall 10 (cf. FIG. 1). The selective soldering of the cable ends 12, 14, 16, 18 can take place in a very simple manner since the individual connection cables 2, 4, 6, 8 are already fixed in position in the predetermined relative position in relation to one another and with respect to the printed circuit board 22. The final assembly of the electronics in the housing thus takes place in one movement and without complex alignment of the cables, with the result that manufacture is considerably simplified compared to the conventional solutions.

The solution according to the invention can in no way be compared with a conventional plug since, in the case of a plug, the connection cables are soldered to contacts within the plug, and these contact pins are then inserted into a mating piece. The cable holder 1 according to the invention, on the other hand, merely serves the purpose of positioning the connection cables 2, 4, 6, 8 with respect to one another and with respect to a housing of the EB or other control device.

The subject matter of the disclosure is a cable holder 1 for a large number of connection cables 2, 4, 6, 8 of an electrical or electronic control device, in particular of an electronic ballast of a lamp. The cable holder 1 has a base body 24, in which receptacles 32, 34, 36, 50 are formed which surround, at least in sections, an insulating sheath of the connection cables 2, 4, 6, 8 and are associated with apertures 38, 40, 42, 52, which open out into an end face 44 of the base body 24, cable ends 12, 14, 16, 18, from which the insulation has been stripped, of the connection cables 2, 4, 6, 8 extending through said apertures 38, 40, 42, 52.

What is claimed is:

1. A cable holder that contains a plurality of connection cables that connects to components of a control device, the cable holder including a base body, the base body comprising:

an insertion opening for receiving the plurality of connection cables;

receptacles for surrounding, at least in sections, an insulating sheath of each connection cable;

an end face; and apertures associated with the receptacles and opening out into the end face, each aperture being adapted to receive a stripped portion of an end of a corresponding connection cable such that the stripped portion extends through the aperture and protrudes out of the end face;

wherein the connection cables are deflected in the base body through approximately 90° such that the ends of the connection cables are offset through 90° with respect to the axis of the connection cables in the insertion opening of the base body.

2. The cable holder as claimed in claim 1, wherein the receptacles are formed by pockets which surround, in an interlocking manner, at least one circumferential section of the insulating sheath of the connection cables.

3. The cable holder as claimed in claim 2, wherein the pockets include lateral slots.

4. The cable holder as claimed in claim 1, wherein the pockets are provided in that region in which the cable ends, which have been deflected through 90°, are arranged.

5. The cable holder as claimed in claim 1, wherein the insertion opening is formed at a further end face of the base body.

6. The cable holder as claimed in claim 5, further comprising a housing bushing for insertion into a housing wall of the control device, wherein the housing bushing is formed in the region of the insertion opening.

7. The cable holder as claimed in claim 6, wherein the housing bushing includes a closure part, which is attached by means of a film hinge and which forms, in its closed position, a circumferential wall section of the insertion opening.

8. The cable holder as claimed in claim 6, wherein the housing bushing includes grooves on its circumference for receiving circumferential edges of the housing wall.

9. A cable holder for a plurality of connection cables for connection to components of a control device, the cable holder including a base body, the base body comprising:

an insertion opening for receiving the plurality of connection cables;

a base plate;

receptacles for surrounding, at least in sections, an insulating sheath of each connection cable;

an end face; and apertures associated with the receptacles and opening out into the end face, each aperture being adapted to receive a stripped portion of an end of a corresponding connection cable such that the stripped portion extends through the aperture and protrudes out of the end face;

wherein the receptacles are formed by pockets which surround, in an interlocking manner, at least one circumferential section of the insulating sheath of the connection cables, the pockets being formed in an accommodating region which protrudes out of the base plate of the base body, the insulating sheaths of the connection cables bearing against the base plate.

10. The cable holder as claimed in claim 9, wherein at least one pocket is provided at an end side formed by a protruding accommodating region and the base plate.

11. The cable holder as claimed in claim 1, wherein the cable holder is produced from plastic in an injection molding method.

12. The cable holder as claimed in claim 1, further comprising bearing projections which are provided at the end face.

13. The cable holder as claimed in claim 1, wherein the control device is an electronic ballast for a lamp.

14. The cable holder as claimed in claim 9, wherein the control device is an electronic ballast for a lamp.

* * * * *